US009587353B2

(12) United States Patent
Jogikalmath et al.

(10) Patent No.: US 9,587,353 B2
(45) **Date of Patent: *Mar. 7, 2017**

(54) ADDITIVES FOR PAPERMAKING

(71) Applicant: NANOPAPER, LLC, Cambridge, MA (US)

(72) Inventors: Gangadhar Jogikalmath, Cambridge, MA (US); Andrea Schneider, Hyde Park, MA (US); David S. Soane, Chestnut Hill, MA (US)

(73) Assignee: NanoPaper, LLC, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/571,154

(22) Filed: Dec. 15, 2014

(65) Prior Publication Data

US 2015/0176210 A1 Jun. 25, 2015

Related U.S. Application Data

(63) Continuation of application No. PCT/US2013/045582, filed on Jun. 13, 2013.

(60) Provisional application No. 61/660,146, filed on Jun. 15, 2012, provisional application No. 61/759,550, filed on Feb. 1, 2013.

(51) Int. Cl.

| | |
|---|---|
| ***D21H 17/28*** | (2006.01) |
| ***D21H 19/12*** | (2006.01) |
| ***D21H 17/37*** | (2006.01) |
| ***D21H 11/20*** | (2006.01) |
| ***D21H 13/24*** | (2006.01) |
| ***D21H 13/26*** | (2006.01) |
| ***D21H 15/10*** | (2006.01) |
| ***D21H 17/21*** | (2006.01) |
| ***D21H 17/63*** | (2006.01) |
| ***D21H 17/67*** | (2006.01) |
| ***D21H 17/69*** | (2006.01) |
| ***D21H 17/70*** | (2006.01) |
| ***D21H 17/00*** | (2006.01) |
| ***D21H 21/16*** | (2006.01) |
| ***D21H 13/14*** | (2006.01) |

(52) U.S. Cl.

CPC ..... *D21H 19/12* (2013.01); *D21H 11/20* (2013.01); *D21H 13/14* (2013.01); *D21H 13/24* (2013.01); *D21H 13/26* (2013.01); *D21H 15/10* (2013.01); *D21H 17/21* (2013.01); *D21H 17/28* (2013.01); *D21H 17/375* (2013.01); *D21H 17/63* (2013.01); *D21H 17/67* (2013.01); *D21H 17/675* (2013.01); *D21H 17/69* (2013.01); *D21H 17/70* (2013.01); *D21H 17/72* (2013.01); *D21H 17/74* (2013.01); *D21H 21/16* (2013.01)

(58) Field of Classification Search

CPC ..... D21H 19/12; D21H 13/14; D21H 17/28

USPC ..... 162/175

See application file for complete search history.

(56) References Cited

U.S. PATENT DOCUMENTS

| | | | |
|---|---|---|---|
| 2,765,228 | A | 10/1956 | Jordan, Jr. |
| 3,017,294 | A | 1/1962 | Meisel |
| 3,352,424 | A | 11/1967 | Guebert et al. |
| 3,468,706 | A | 9/1969 | Speakman |
| 3,673,110 | A | 6/1972 | Edwards |
| 3,930,877 | A | 1/1976 | Aitken |
| 3,932,275 | A | 1/1976 | Mewes et al. |
| 4,029,885 | A | 6/1977 | Buikema |
| 4,239,592 | A | 12/1980 | Gaspar et al. |
| 4,346,010 | A | 8/1982 | Ogino et al. |
| 4,347,100 | A | 8/1982 | Brucato |
| 4,363,749 | A | 12/1982 | Weiss et al. |
| 4,498,993 | A | 2/1985 | Raba, Jr. et al. |
| 4,505,775 | A | 3/1985 | Harding et al. |
| 4,609,432 | A | 9/1986 | Brucato |
| 4,721,655 | A | 1/1988 | Trzasko et al. |
| 4,872,951 | A | 10/1989 | Maliczyszyn et al. |
| 4,882,066 | A | 11/1989 | Portier |
| 4,913,585 | A | 4/1990 | Thompson et al. |
| 4,925,530 | A | 5/1990 | Sinclair et al. |
| 5,032,683 | A | 7/1991 | Dragner et al. |
| 5,158,646 | A | 10/1992 | Nakajima |
| 5,190,660 | A | 3/1993 | Lindoy et al. |
| 5,221,435 | A | 6/1993 | Smith, Jr. |
| 5,294,301 | A | 3/1994 | Kumar et al. |

(Continued)

FOREIGN PATENT DOCUMENTS

| | | |
|---|---|---|
| AU | 640296 | 6/1992 |
| CN | 101087733 A | 12/2007 |

(Continued)

OTHER PUBLICATIONS

Blumenschein, C. D., et al., "Sand Ballasted High Rate Clarification Process for Treatment of Process Water," available online at http://web.cecs.pdx.edu/~fishw/UO_Ballast-Actiflo.pdf. Oct. 2006.

"Actiflo™ Process : Key to Efficient High-Rate Clarification," available online at http://www.veoliawaterst.com/indepth/mining_fluent/13262,actiflo_process.htm. (retrieved from the internet on Nov. 16, 2010).

Muylwyk, Q., et al., "Practical experiences in sand ballasted clarification processes," Proceedings of the Annual Conference of the Western Canada Water and Wastewater Association, Abstract (2004).

(Continued)

*Primary Examiner* — Mark Halpern

(74) *Attorney, Agent, or Firm* — Elmore Patent Law Group, P.C.; Mahreen Chaudhry Hoda; Carolyn S. Elmore, Esq.

(57) ABSTRACT

The invention is directed to systems for papermaking comprising a first population of fibers dispersed in an aqueous solution and complexed with an activator, and a second population of composite additive particles bearing a tethering material, wherein the addition of the second population to the first population attaches the composite additive particles to the fibers. The invention also encompasses methods for manufacturing a paper product.

14 Claims, 9 Drawing Sheets

(56) References Cited

U.S. PATENT DOCUMENTS

| | | | |
|---|---|---|---|
| 5,393,435 | A | 2/1995 | Deans et al. |
| 5,433,865 | A | 7/1995 | Laurent |
| 5,449,464 | A | 9/1995 | El-Shall |
| 5,453,206 | A | 9/1995 | Browne |
| 5,543,056 | A | 8/1996 | Murcott et al. |
| 5,595,631 | A | 1/1997 | Tsai et al. |
| 5,690,790 | A | 11/1997 | Headlam et al. |
| 5,703,272 | A | 12/1997 | Abe et al. |
| 5,798,046 | A | 8/1998 | Greer et al. |
| 5,876,563 | A | 3/1999 | Greenwood |
| 5,972,100 | A | 10/1999 | Dumas |
| 6,117,545 | A | 9/2000 | Cavaille et al. |
| 6,203,711 | B1 | 3/2001 | Moffett |
| 6,235,835 | B1 | 5/2001 | Niessner et al. |
| 6,303,000 | B1 | 10/2001 | Floyd et al. |
| 6,361,651 | B1 | 3/2002 | Sun |
| 6,712,934 | B2 | 3/2004 | Ahlgren et al. |
| 6,849,156 | B2 | 2/2005 | Besemer et al. |
| 6,890,431 | B1 | 5/2005 | Eades et al. |
| 6,919,031 | B2 | 7/2005 | Blumenschein et al. |
| 7,001,525 | B2 | 2/2006 | Binot et al. |
| 7,074,845 | B2 | 7/2006 | Laleg |
| 7,153,436 | B2 | 12/2006 | Bair et al. |
| 7,255,793 | B2 | 8/2007 | Cort |
| 7,625,962 | B2 | 12/2009 | Laleg |
| 7,704,328 | B2 | 4/2010 | Bailey et al. |
| 7,901,583 | B2 | 3/2011 | McColl et al. |
| 7,964,063 | B2 | 6/2011 | Deng et al. |
| 8,168,003 | B2 | 5/2012 | Bailey et al. |
| 8,414,739 | B2 | 4/2013 | Kimura et al. |
| 8,894,863 | B2 | 11/2014 | Soane et al. |
| 2001/0021453 | A1 | 9/2001 | Hansen et al. |
| 2002/0139754 | A1 | 10/2002 | Miller |
| 2004/0116304 | A1 | 6/2004 | Wu et al. |
| 2006/0121814 | A1 | 6/2006 | Vinson et al. |
| 2006/0151360 | A1 | 7/2006 | Wright et al. |
| 2006/0257678 | A1 | 11/2006 | Benson et al. |
| 2007/0085055 | A1 | 4/2007 | Sikes et al. |
| 2007/0209971 | A1 | 9/2007 | Duyvesteyn et al. |
| 2007/0289911 | A1 | 12/2007 | Cymerman et al. |
| 2008/0265222 | A1 | 10/2008 | Ozersky et al. |
| 2008/0271865 | A1 | 11/2008 | Soane et al. |
| 2009/0206040 | A1 | 8/2009 | Berg et al. |
| 2010/0098493 | A1 | 4/2010 | McColl et al. |
| 2011/0094970 | A1 | 4/2011 | Kincaid et al. |
| 2011/0131873 | A1 | 6/2011 | Soane et al. |
| 2011/0186253 | A1 | 8/2011 | Wielema |
| 2011/0247772 | A1 | 10/2011 | Kincaid et al. |
| 2011/0252701 | A1 | 10/2011 | Soane et al. |
| 2012/0029120 | A1 | 2/2012 | Soane et al. |
| 2012/0061321 | A1 | 3/2012 | Soane et al. |
| 2012/0067824 | A1 | 3/2012 | Berg et al. |
| 2012/0132383 | A1 | 5/2012 | Laine et al. |
| 2012/0152476 | A1 | 6/2012 | Jogikalmath et al. |
| 2012/0264603 | A1 | 10/2012 | Soane et al. |
| 2012/0267315 | A1 | 10/2012 | Soane et al. |
| 2012/0285644 | A1 | 11/2012 | Soane et al. |
| 2013/0134103 | A1 | 5/2013 | Berg et al. |
| 2013/0193078 | A1 | 8/2013 | Soane et al. |
| 2013/0336877 | A1 | 12/2013 | Soane et al. |
| 2014/0014586 | A1 | 1/2014 | Soane et al. |
| 2014/0166222 | A1 | 6/2014 | Delrue et al. |
| 2014/0224443 | A1 | 8/2014 | Jogikalmath et al. |
| 2015/0101769 | A1 | 4/2015 | Laine et al. |
| 2015/0101770 | A1 | 4/2015 | Laine et al. |
| 2015/0144279 | A1 | 5/2015 | Laine et al. |

FOREIGN PATENT DOCUMENTS

| | | | |
|---|---|---|---|
| EP | 2196478 | A1 | 6/2010 |
| JP | 08143601 | A | 6/1996 |
| WO | 9712917 | A1 | 4/1997 |
| WO | 2004/060819 | A1 | 7/2004 |
| WO | 2006047225 | A2 | 5/2006 |
| WO | 2010033960 | A1 | 3/2010 |
| WO | 2010098786 | A1 | 9/2010 |
| WO | 2011/019811 | A1 | 2/2011 |
| WO | 2013033368 | A1 | 3/2013 |

OTHER PUBLICATIONS

Zhang, et al. "Development of an Ultra-fine Coal Dewatering Technology and an Integrated Flotation-Dewatering System for Coal Preparation Plants," DOE Grant Final Report. Mar. 1, 2007.

Jogikalmath, et al., U.S. Appl. No. 15/000,286, filed Jan. 19, 2016.

| Table 1: Hydrophobicity (Water Droplet Holdout) | | |
|---|---|---|
| condition | description | holdout s |
| 1 | Pulp | 1 |
| 2 | pulp + latex-coated starch (no ATA) | 2 |
| 3 | pulp + latex-coated starch + ATA | 97 |
| 4 | pulp + latex-coated starch (activator only) | 145 |

FIG. 3

Table 2: Hydrophobicity (Water Droplet Holdout)

| condition | Description | water holdout s | notes |
|---|---|---|---|
| 1 | Pulp only | 27 | |
| 2 | Pulp + PP fiber 15% | 697 | |
| 3 | Pulp + PP fiber 15% + NP ATA | >7200 | droplet still remains at 2 hours |
| 4 | Pulp + Nylon 15% | 10 | |
| 5 | Pulp + Nylon 15% w/ ATA | 30 | |
| 6 | Pulp + Nylon 2% + PP 13% | 7200 | |
| 7 | Pulp + Nylon 2% + PP 13% w/ ATA | 7200 | |

FIG. 5

Table 3: Hydrophobicity (Water Droplet Holdout)

| condition | description | water holdout s | notes |
|---|---|---|---|
| 1 | Pulp only | 27 | |
| 2 | Pulp + PP fiber 15% | 697 | |
| 3 | Pulp + Chitosan-coated PP fiber 15% | >7200 | droplet still remains at 2 hours |

FIG. 7

ADDITIVES FOR PAPERMAKING

RELATED APPLICATIONS

This application is a continuation of International Application No. PCT/US13/45582, which designated the United States and was filed on Jun. 13, 2013, published in English, which claims the benefit of U.S. Provisional Application Ser. No. 61/660,146, filed Jun. 15, 2012 and U.S. Provisional Application Ser. No. 61/759,550 filed Feb. 1, 2013. The entire contents of the above applications are incorporated by reference herein.

FIELD OF THE APPLICATION

This application relates generally to making high-strength paper products with specific functionalities.

BACKGROUND

Many paper applications require not only high strength but also functionalities that provide the paper article with moisture, oil and grease, mold and fire resistance, increased brightness, or other specialized functionalities like antimicrobial properties or magnetic properties. Certain of these products are currently manufactured by imparting paper a coating in a secondary process. In one approach for adding functionality to the paper surface, the sizing process uses cooked starch solutions with additives (such as brightening agents, clays, hydrophobicizing compounds) to impart surface functionality to the paper. In the sizing process, the wet web is first dried to a pre-set moisture content and/or is re-wet to achieve uniform moisture content throughout; then the material is fed into a size press where a high loading of gelatinized starch with additives is applied to the paper surface; then the material is dried again. This process involves a number of downstream processes that can be inefficient. Inefficiencies result from the number of steps involved in preparing the substrate, cooking the starch and applying it to form the finished product. A considerable amount of energy is required for these steps, which adds to the costs of the process.

For certain paper products, functionalities can be added by incorporating additives into the fibrous matrix during the papermaking process. Particulate additives can be introduced into the paper web, substituting for some of the pulp that might be used otherwise. These particulate fillers can create, for example, a bulky final paper product that creates the impression of higher quality through its tactile properties while minimizing the use of expensive pulp. Particulate fillers can also be used to impart other specialized properties besides bulk. For example, particulate additives can include filler particles, or other particles, suitable for use papermaking or a final paper product can include mineral particles such as calcium carbonate, dolomite, calcium sulfate, kaolin, talc, titanium dioxide, silica, aluminum hydroxide, and the like. Particles can be formed from inorganic or organic materials, and may be solid or porous. Organic particles may be polymeric, optionally crosslinked, and may be elastomeric. A wide variety of particles known in the art can be incorporated into the finished paper product to improve performance attributes such as brightness, opacity, smoothness, ink receptivity, fire retardance, water resistance, bulk, and the like.

Precipitated Calcium Carbonate (PCC) is particularly useful as a particulate filler additive where high opacity, brightness and maintenance of caliper are required. Higher PCC contents replace expensive pulp improving the profitability of paper. Although PCC contents as high as 15% are often used in papermaking, the first pass retention of the filler is poor, so that a significant amount can be lost from the paper product during the papermaking process. The PCC that is incorporated into the paper product also leads to weaker sheets, because the particles themselves disrupt the hydrogen bonding between cellulose fibers. Higher ash content (>15%) is highly desired in the paper industry, where ash content indicates the amount of filler in a paper.

In another embodiment, TiO2 particles are highly desired as particulate fillers to improve the opacity and brightness beyond what is achievable using PCC. The TiO2 particles due to their small size and high refractive index are capable of scattering light and improving the opacity of the paper containing them. As the TiO2 particles are many times more expensive than PCC, improvement in retention is highly desired. Although flocculants can be used to improve the retention of TiO2, the flocculated TiO2 particles do not possess the same optical properties as the individual TiO2 platelets. It would be advantageous to combine TiO2 particles with other particles to form a composite that separates individual TiO2 particles and allows them to retain their optical characteristics.

Other particulate fillers can be added to the paper product to impart specific, desirable properties. As an example, magnetic or paramagnetic particles can be incorporated into the paper to form a magnetic or a magnetizable paper. As another example, colloidal silver particles can be introduced into a paper product to impart antimicrobial properties. A large number of additives can be contemplated that are available in particulate form, including additives that impart oil or grease resistance, optical brightening, ink binding, dust control, water repellency, stiffness, biocidal properties, bioactive properties (e.g., a biomolecule for controlled release), adhesive properties, diagnostic sensing, filtration assist, targeted capture/sequestration, and the like. For particulate additives, proper distribution within the paper matrix is important. For particulate additives that are expensive, proper retention is also important. And with the addition of any additive, its impact on the strength, stiffness and bulk of the final paper product must be considered.

A variety of other additives can be used to impart desirable properties to paper products, but face some of the same challenges: retention, distribution and impact on paper quality. Some other additives used presently to impart various functionalities to paper include synthetic fibers (imparting strength and hydrophobicity and absorbency characteristics), latex colloids (imparting properties such as hydrophobicity, oil and grease resistance, mold resistance, fire retardancy, impact resistance), etc. These components have poor affinity to pulp fibers, though, owing to lack of functional groups capable of interacting with cellulose fibers. As an example, latex colloids are particularly useful for imparting resilience, barrier properties, bulk, impact resistance, damping, and the like. Latex particles that are micron or submicron sized (typically 100 nm particles) suspended in an aqueous solution are particularly suited for use in papermaking. However, latex is typically water-insoluble, and can be integrated only with great difficulty into an aqueous process like papermaking.

It is desirable, therefore, to have a process where an additive capable of delivering added functionality can be mixed with pulp fibers in the wet-end of papermaking such that the additive becomes an integral part of it. It is desirable that such additives be distributed evenly and appropriately within the paper matrix, and that the additives be retained on the product and not lost in the whitewater. It is further desirable to introduce such additives so that they preserve the strength and resiliency of the final paper product.

As an example, there exists a particular need in the art for systems and methods that incorporate and retain colloidal latex particles in the wet end so that high amounts of these fillers are dispersed uniformly in the paper providing paper with desired functionalities. These colloidal latex fillers should, desirably, be incorporated so that they are stably anchored to the pulp fibers, allowing them to expand or gelatinize during paper manufacturing without being dislodged. In this manner, the fillers can occupy the interstitial spaces between cellulose fibers more completely, improving the properties of the paper product. Furthermore, it is known that high filler content has a detrimental effect on the strength of the wet web before it is dried because the fillers act as spacers and interfere with fiber-fiber bonding. An efficient retention system that attaches the latex fillers to fibers durably in the wet web can advantageously enhance wet web strength during processing by allowing fiber-fiber bonding to proceed unimpeded.

SUMMARY

Disclosed herein in embodiments systems for papermaking, comprising a first population of fibers dispersed in an aqueous solution and complexed with an activator, and a second population of composite additive particles bearing a tethering material, wherein the addition of the second population to the first population attaches the composite additive particles to the fibers by the interaction of the activator and the tethering material. In embodiments, the first population comprises cellulosic fibers. In embodiments, the first population comprises synthetic fibers. In embodiments, the composite additive particles comprise a particle selected from the group of a PCC particle, a TiO2 particle, a magnetic particle, and a silver colloid particle. In embodiments, the composite additive particles comprise a latex component and a starch component. Further disclosed herein are oil and/or grease resistant paper products comprising the system as described above, wherein the composite additive particles comprise a hydrophobic starch, and an oil and/or grease-resistant coating.

Also disclosed herein, in embodiments, are methods for manufacturing a paper product, comprising activating a first population of fibers in a liquid medium with an activator, forming a second population of composite additive particles, treating the second population with a tethering material to form tether-bearing composite additive particles, wherein the tethering material is capable of interacting with the activator, adding the second population to the activated population of fibers to form a treated paper matrix, and forming the paper matrix to manufacture the paper product. In embodiments, the first population comprises cellulosic fibers. In embodiments, the first population comprises synthetic fibers. In embodiments, the composite additive particles comprise a particle selected from the group of a PCC particle, a TiO2 particle, a magnetic particle, and a silver colloid particle. In embodiments, the composite additive particles comprise a latex component and a starch component. In other embodiments, the methods further comprise adding an oil and/or grease resistant coating to the paper matrix, wherein the paper matrix comprises tether-bearing composite additive particles that comprise a hydrophobic starch.

BRIEF DESCRIPTION OF THE FIGURES

FIG. 3 shows a table indicating hydrophobicity for various samples.

FIG. 5 shows a table indicating hydrophobicity for various samples.

FIG. 7 shows a table indicating hydrophobicity for various samples.

DETAILED DESCRIPTION

Figure 1:
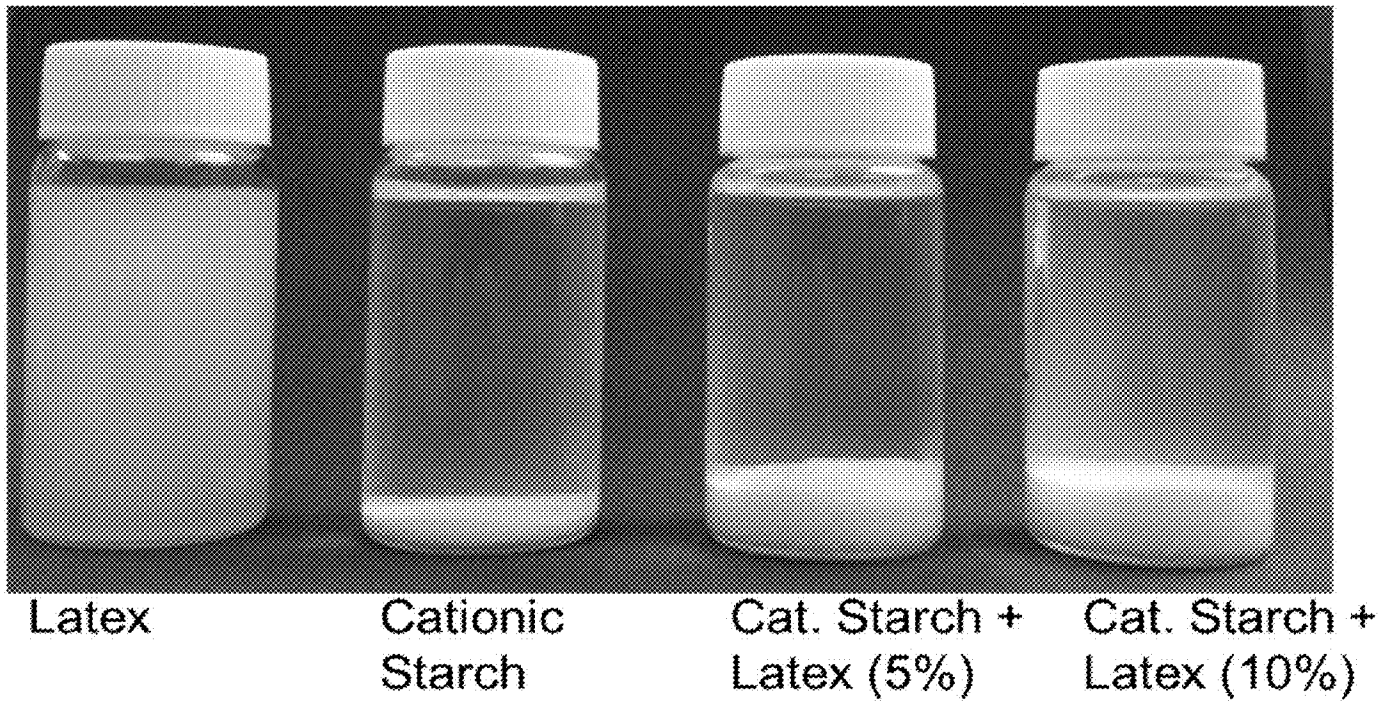
FIG. 1 shows a photograph of samples of latex and cationic starch in water.

Disclosed herein are systems and methods for attaching additives to cellulose fibers in a paper product. In embodiments, the additives are combined to form composite particles, and the composite particles are attached to the cellulose fibers. Composite particles can be formed by attaching two or more additives to each other; the composite particles can then be attached to the cellulose fibers. Three steps can be performed to effect the attachment of composite particle to cellulose fibers. In one step, the cellulose fibers are modified by the attachment of an agent, called an "activating agent" or "activator" that prepares the surface of the fibers for attachment to a suitably-modified composite particle. In another step, the composite particle is formed as will be described in more detail below. The composite particle is then modified by attaching a tethering agent to the particle, where the tethering agent has a particular affinity for the activating agent attached to the paper fibers. The tether-bearing composite additive particles are then admixed with the activated fibers, so that the activating agent and the tethering agents interact: this interaction durably affixes the composite additive particles bearing the tethers to the fibers bearing the activators. In embodiments, the cellulose fibers can be treated with a cationic polymer of a specific molecular weight and composition as an activator, and the composite additive particles are treated with an anionic polymer as a tethering agent; these separately-treated populations are then combined so that the composite additive particles are attached to the pulp fibers. In embodiments, the combination of these processes can be referred to as an "Anchor-Tether-Activator," or "ATA" system. In this system, the cellulose fibers are treated with the activator, as will be described below in more detail; the composite additive particle acts as an "anchor particle" that is treated with the tethering agent. The tether-bearing anchor particles, when mixed with the activated cellulose fibers, become attached thereto, so that the composite additive particles become durably affixed to the cellulose and appropriately distributed throughout the cellulose matrix.

In embodiments, the tethering agent also acts to attach the component additives to each other to form a composite additive particle. This use of the tethering agent can allow the creation of composite particles from components that have no intrinsic attraction to each other. For example, PCC and TiO2 can be combined to form a composite additive particle using the tethering agent as a "glue" to hold the components together as a composite. Or, for example, TiO2 can be combined with another additive, such as clay, to form a composite additive particle, using the tether as a "glue" to hold the composite together. The composite additive particle, thus treated with the tethering agent, forms a tether-bearing composite particle that is affixable to the activator-treated cellulose fibers in the anchor-tether-activator system as described herein.

In embodiments, the components of the composite additive particle can be attached to each other intrinsically. In one embodiment, for example, starch granules and PCC particles can be mixed together physically to form a composite particle slurry. PCC is slightly cationic at the pH used for papermaking, which makes it easier to bond with anionic starch granules. With neutral or uncharged starch granules, PCC can be mixed at high shear to form a composite additive particle slurry that can then be modified with tethering agent.

As another example, colloidal latex particles can interact electrostatically with granular starch of opposite charge resulting in a composite latex/starch additive particle. The composite latex-starch additive particle can then be treated with a tethering agent as described herein, and affixed to the activated cellulose fibers. When prepared and deployed in accordance with these systems and methods, such a composite latex/starch additive can then used as functional additive with appropriate chemistry to improve bonding and retention in the pulp in the wet-end of papermaking. In embodiments, the granular starch particles can be used to deliver the latex into the papermaking web so that they are distributed throughout the fibrous matrix. Attached to the starch granules by electrostatic attraction, the latex particles then become embedded uniformly in the fibrous web. As the starch granules gelatinize during the papermaking process, they further spread the attached latex particles throughout the paper and onto the surface of the paper. These latex particles, depending on their melting or softening point, may then be advantageously incorporated in the final paper product, for example, forming a film in the paper during the paper drying process or otherwise imparting desirable latex properties to the final paper product.

In embodiments, latex polymers are selected that are oppositely charged from the starch granule that is selected to form the composite. Thus, latex/starch composites are formed and stabilized by electrostatic forces. As used herein, the term "latex" refers to a lyophobic colloidal suspension of a synthetic polymer in a liquid phase which is produced by a polymerization reaction ex vivo. The term "latex polymer" or "latex particle" refer to the polymeric material suspended in such a colloidal suspension. Examples of latex polymers or particles include styrene-butadiene rubber, acrylonitrile butadiene styrene, acrylic polymers, polyvinyl acetate polymers, and the like.

For the uses as disclosed herein, a suitable latex can be chosen from a wide variety of polymers. Some species of latex are inert polymers (Polyvinylacetate) while some are reactive (acrylic based), capable of flowing and crosslinking in the high temperature encountered in the drying section of paper making Latex can also be selected according to the properties of its component polymers. For example, a useful latex can be comprised of glassy polymers such as polystyrene when stiffness is required, or rubbery polymers such as styrene-butadiene copolymers, when flexibility is required. In embodiments, a cationic latex is used that can be combined with a negatively charged starch particle.

Composite starch-latex additive particles as described herein can then be attached to the fibrous matrix formed by the papermaking process. The composite starch-latex particles, however, lack strong affinity to the natural and/or synthetic fibers used to form the paper web. Hence, additional steps as disclosed herein can be performed to attach the composite starch-latex particles to the fibrous web.

In embodiments, three steps as described previously can be performed to effect this attachment. In one step, the fibers are modified by the attachment of an agent, called an "activating agent," that prepares the surface of the fibers for attachment to a suitably-modified composite starch-latex particle. In another step, the starch-latex particle is modified by attaching a tethering agent to the particle, where the tethering agent has a particular affinity for the activating agent attached to the paper fibers. The tether-bearing starch-latex particles are then admixed with the activated fibers, so that the activating agent and the tethering agents interact: this interaction durably affixes the composite particles bearing the tethers to the fibers bearing the activators. In embodiments, these systems and methods can be used to treat fibers used in papermaking with a cationic polymer of a specific molecular weight and composition as an activator, to treat composite starch-latex granules with an anionic polymer as a tethering agent, and to combine these separately-treated populations so that the starch granules are attached to the pulp fibers.

1. Activation

As used herein, the term "activation" refers to the interaction of an activating material, such as a polymer, with suspended particles or fibers in a liquid medium, such as an aqueous solution. An "activator," for example an "activator polymer," can carry out this activation. In embodiments, high molecular weight polymers can be introduced into the particulate or fibrous dispersion as activator polymers, so that these polymers interact, or complex, with the dispersed particles or fibers. The polymer-fiber complexes interact with other similar complexes, or with other fibers, and form agglomerates.

This "activation" step can function as a pretreatment to prepare the surface of the suspended material (e.g., fibers) for further interactions in the subsequent phases of the disclosed system and methods. For example, the activation step can prepare the surface of the suspended materials to interact with other polymers that have been rationally designed to interact therewith in a subsequent "tethering" step, as described below. Not to be bound by theory, it is believed that when the suspended materials (e.g., fibers) are coated by an activating material such as a polymer, these coated materials can adopt some of the surface properties of the polymer or other coating. This altered surface character in itself can be advantageous for retention, attachment and/or dewatering.

In another embodiment, activation can be accomplished by chemical modification of the suspended material. For example, oxidants or bases/alkalis can increase the negative surface energy of fibers or particles, and acids can decrease the negative surface energy or even induce a positive surface energy on suspended material. In another embodiment, electrochemical oxidation or reduction processes can be used to affect the surface charge on the suspended materials. These chemical modifications can produce activated particulates that have a higher affinity for tethered anchor particles as described below.

Suspended materials suitable for modification, or activation, can include organic or inorganic particles, or mixtures thereof. Inorganic particles can include one or more materials such as calcium carbonate, dolomite, calcium sulfate, kaolin, talc, titanium dioxide, sand, diatomaceous earth, aluminum hydroxide, silica, other metal oxides and the like. Organic particles can include one or more materials such as starch, modified starch, polymeric spheres (both solid and hollow), carbon based nanoparticles such as carbon nanotubes and the like. Particle sizes can range from a few nanometers to few hundred microns. In certain embodiments, macroscopic particles in the millimeter range may be suitable.

In embodiments, suspended materials may comprise materials such as lignocellulosic material, cellulosic material, minerals, vitreous material, cementitious material, carbonaceous material, plastics, elastomeric materials, and the like. In embodiments, cellulosic and lignocellulosic materials may include wood materials such as wood flakes, wood fibers, wood waste material, wood powder, lignins, wood pulp, or fibers from woody plants.

The "activation" step may be performed using flocculants or other polymeric substances. Preferably, the polymers or flocculants can be charged, including anionic or cationic polymers.

In embodiments, anionic polymers can be used, including, for example, olefinic polymers, such as polymers made from polyacrylate, polymethacrylate, partially hydrolyzed polyacrylamide, and salts, esters and copolymers thereof, such as sodium acrylate/acrylamide copolymers, sulfonated polymers, such as sulfonated polystyrene, and salts, esters and copolymers thereof. Suitable polycations include: polyvinylamines, polyallylamines, polydiallyldimethylammoniums (e.g., the chloride salt), branched or linear polyethyleneimine, crosslinked amines (including epichlorohydrin/dimethylamine, and epichlorohydrin/alkylenediamines), quaternary ammonium substituted polymers, such as (acrylamide/dimethylaminoethylacrylate methyl chloride quat) copolymers and trimethylammoniummethylene-substituted polystyrene, and the like. Nonionic polymers suitable for hydrogen bonding interactions can include polyethylene oxide, polypropylene oxide, polyhydroxyethylacrylate, polyhydroxyethylmethacrylate, and the like. In embodiments, an activator such as polyethylene oxide can be used as an activator with a cationic tethering material in accordance with the description of tethering materials below. In embodiments, activator polymers with hydrophobic modifications can be used. Flocculants such as those sold under the trademark MAGNAFLOC® by Ciba Specialty Chemicals can be used.

In embodiments, activators such as polymers or copolymers containing carboxylate, sulfonate, phosphonate, or hydroxamate groups can be used. These groups can be incorporated in the polymer as manufactured. Alternatively they can be produced by neutralization of the corresponding acid groups, or generated by hydrolysis of a precursor such as an ester, amide, anhydride, or nitrile group. The neutralization or hydrolysis step could be done on site prior to the point of use, or it could occur in situ in the process stream.

The activated suspended material (e.g., fiber) can also be an amine functionalized or modified. As used herein, the term "modified material" can include any material that has been modified by the attachment of one or more amine functional groups as described herein. The functional group on the surface of the suspended material can be from modification using a multifunctional coupling agent or a polymer. The multifunctional coupling agent can be an amino silane coupling agent as an example. These molecules can bond to a material's surface and then present their amine group for interaction with the particulate matter. In the case of a polymer, the polymer on the surface of a suspended fiber or particle can be covalently bound to the surface or interact with the surface of the particle and/or fiber using any number of other forces such as electrostatic, hydrophobic, or hydrogen bonding interactions. In the case that the polymer is covalently bound to the surface, a multifunctional coupling agent can be used such as a silane coupling agent. Suitable coupling agents include isocyano silanes and epoxy silanes as examples. A polyamine can then react with an isocyano silane or epoxy silane for example. Polyamines include polyallyl amine, polyvinyl amine, chitosan, and polyethyleneimine.

In embodiments, polyamines (polymers containing primary, secondary, tertiary, and/or quaternary amines) can also self-assemble onto the surface of the suspended particles or fibers to functionalize them without the need of a coupling agent. For example, polyamines can self-assemble onto the surface of the particles or fibers through electrostatic interactions. They can also be precipitated onto the surface in the case of chitosan for example. Since chitosan is soluble in acidic aqueous conditions, it can be precipitated onto the surface of suspended material by adding a chitosan solution to the suspended material at a low pH and then raising the solution pH.

In embodiments, the amines or a majority of amines are charged. Some polyamines, such as quarternary amines are fully charged regardless of the pH. Other amines can be charged or uncharged depending on the environment. The polyamines can be charged after addition onto the suspended particles or fibers by treating them with an acid solution to protonate the amines. In embodiments, the acid solution can be non-aqueous to prevent the polyamine from going back into solution in the case where it is not covalently attached to the particle or fiber.

The polymers or particles can complex via forming one or more ionic bonds, covalent bonds, hydrogen bonding and combinations thereof, for example. Ionic complexing is preferred.

To obtain activated suspended materials, the activator could be introduced into a liquid medium through several different means. For example, a large mixing tank could be used to mix an activating material with fine particulate materials. Activated particles or fibers are produced that can be treated with one or more subsequent steps of attachment to tether-bearing anchor particles.

2. Tethering

As used herein, the term "tethering" refers to an interaction between an activated suspended particle or fiber and an additive particle, herein termed an anchor particle (as described below). The additive particle, for example, a composite additive particle, ("anchor particle") can be treated or coated with a tethering material. The tethering material, such as a polymer, forms a complex or coating on the surface of the anchor particles such that the tethered anchor particles have an affinity for the activated suspended material. In embodiments, the selection of tether and activator materials is intended to make the two solids streams complementary so that the activated particles or fibers in the suspension become tethered, linked or otherwise attached to the anchor particle.

In accordance with these systems and methods, the tethering material acts as a complexing agent to affix the activated particles or fibers to the additive particle anchor material. In embodiments, a tethering material can be any type of material that interacts strongly with the activating material and that is connectable to an anchor particle. Composite latex-starch particles are an example of an additive particle or anchor particle that can be treated with a tethering agent.

In embodiments, various interactions such as electrostatic, hydrogen bonding or hydrophobic behavior can be used to affix an activated complex to a tethering material complexed with an anchor particle.

For use in papermaking, an anchor particle can be selected from any particulate matter that is desirably attached to cellulose fibers in the final paper product. The tether-bearing anchor particle comprising the desirable additive can then interact with the activated cellulose fibers in the wet paper stream. As an example, starch granules can be used as an anchor particle to be attached to the cellulose fibers, as is described in more detail below. Or, as described herein, composite latex-starch granules can be used as anchor particles, to be attached via tethering agents to activated cellulosic or synthetic fibers.

In embodiments, polymers such as linear or branched polyethyleneimine can be used as tethering materials. It would be understood that other anionic or cationic polymers could be used as tethering agents, for example polydiallyldimethylammonium chloride (poly(DADMAC)). In other embodiments, cationic tethering agents such as epichlorohydrin dimethylamine (epi/DMA), styrene maleic anhydride imide (SMAI), polyethylene imide (PEI), polyvinylamine, polyallylamine, amine-aldehyde condensates, poly(dimethylaminoethyl acrylate methyl chloride quaternary) polymers and the like can be used. Advantageously, cationic polymers useful as tethering agents can include quaternary ammonium or phosphonium groups. Advantageously, polymers with quaternary ammonium groups such as (poly(DADMAC)) or epi/DMA can be used as tethering agents. In other embodiments, polyvalent metal salts (e.g., calcium, magnesium, aluminum, iron salts, and the like) can be used as tethering agents. In other embodiments cationic surfactants such as dimethyldialkyl(C8-C22)ammonium halides, alkyl(C8-C22)trimethylammonium halides, alkyl(C8-C22)dimethylbenzylammonium halides, cetyl pyridinium chloride, fatty amines, protonated or quaternized fatty amines, fatty amides and alkyl phosphonium compounds can be used as tethering agents. In embodiments, polymers having hydrophobic modifications can be used as tethering agents.

The efficacy of a tethering material, however, can depend on the activating material. A high affinity between the tethering material and the activating material can lead to a strong and/or rapid interaction there between. A suitable choice for tether material is one that can remain bound to the anchor surface, but can impart surface properties that are beneficial to a strong complex formation with the activator polymer. For example, a polyanionic activator can be matched with a polycationic tether material or a polycationic activator can be matched with a polyanionic tether material. In one embodiment, a poly(sodium acrylate-co-acrylamide) activator is matched with a chitosan tether material.

In hydrogen bonding terms, a hydrogen bond donor should be used in conjunction with a hydrogen bond acceptor. In embodiments, the tether material can be complementary to the chosen activator, and both materials can possess a strong affinity to their respective deposition surfaces while retaining this surface property.

In other embodiments, cationic-anionic interactions can be arranged between activated suspended materials and tether-bearing anchor particles. The activator may be a cationic or an anionic material, as long as it has an affinity for the suspended material to which it attaches. The complementary tethering material can be selected to have affinity for the specific anchor particles being used in the system. In other embodiments, hydrophobic interactions can be employed in the activation-tethering system.

3. Retention and Incorporation in Papermaking

It is envisioned that the complexes formed from the additive or composite additive ("anchor") particles and the activated fibrous matter can form a homogeneous part of a fibrous product like paper. In embodiments, the interactions between the activated suspended fibers and the tether-bearing anchor particles can enhance the mechanical properties of the complex that they form. For example, an activated suspended material can be durably bound to one or more tether-bearing anchor particles, so that the tether-bearing anchor particles do not segregate or move from their position on the fibers. Increased compatibility of the activated fine materials with a denser (anchor) matrix modified with the appropriate tether polymer can lead to further mechanical stability of the resulting composite material. For example, using latex-starch composites as tether-bearing anchor particles permits the latex to attach durably to the paper fibers; the gelatinization of the starch combined with the melting of the latex allows the flowable latex to permeate the paper fibers and impart desirable properties thereto.

For papermaking, cationic and anionic polymers for activators and tethering agents (respectively) can be selected from a wide variety of available polymers, as described above. In embodiments, starch granules used to form starch-latex composites can be used in their native state, or they can be modified with short amine side-groups, with amine polymers, or with hydrophobic side groups (each a "modified starch"). The presence of amines on the surface of the starch granules can help in attaching an anionic tethering polymer.

For activating the cellulose fibers, cationic polymers can be used. The polycation can be linked to the fiber surface using a coupling agent, for example a bifunctional crosslinking agent such as a carbonyldiimidazole or a silane, or the polyamine can self-assemble onto the surface of the cellulose fiber through electrostatic, hydrogen bonding, or hydrophobic interactions. In embodiments, the polyamine can spontaneously self-assemble onto the fiber surface or it can be precipitated onto the surface. For example, in embodiments, chitosan can be precipitated on the surface of the cellulose fibers to activate them. Because chitosan is soluble only in an acidic solution, it can be added to a cellulose fiber dispersion at an acidic pH, and then can be precipitated onto the surface of the cellulose fibers by slowly adding base to the dispersion until chitosan is no longer soluble. In embodiments, a difunctional crosslinking agent can be used to attach the polycation to the fiber, by reacting with both the polycation and the fiber.

In other embodiments, a polycation such as a polyamine can be added directly to the fiber dispersion or slurry. For example, the addition level of the polycation can be between about 0.01% to 5.0% (based on the weight of the fiber), e.g., between 0.1% to 2%. For example, if the cellulose fiber population is treated with a polyamine like polyDADMAC, a separately treated population of tether-bearing starch granules can be mixed in thereafter, resulting in the attachment of the starch-latex composites to the cellulose fibers by the interaction of the activator polymer and the tether polymer. In embodiments, starch-latex composites can be treated with a variety of anionic polymers, such as anionic polyacrylamide, which then act as tethers.

Starch that is to be treated in accordance with these systems and methods can be further derivatized or coated with moieties that impart desirable properties, e.g., hydrophobicity, oleophobicity or both. Starches thus modified may be also termed "modified starches." Preferred oil resistant coating formulations are aqueous solutions of cellulose derivatives such as methylcellulose, ethyl cellulose, propyl cellulose, hydroxypropyl methyl cellulose, hydroxyethyl methyl cellulose, ethylhydroxypropyl cellulose, and ethylhydroxyethyl cellulose, cellulose acetate butyrate, which may further comprise polyvinyl alcohol and/or its derivatives. Another group of preferred oil resistant coating compositions are latex emulsions such as the emulsions of polystyrene, styrene-acrylonitrile copolymer, carboxylated styrene-butadiene copolymer, ethylene-vinyl chloride copolymer, styrene-acrylic copolymer, polyvinyl acetate, ethylene-vinyl acetate copolymer, and vinyl acetate-acrylic copolymer. The starch granule thus coated with grease resistant formulations could be attached to the activated pulp fibers via tethering, such that the surface segregation of the starch granule will modify the surface of the paper product.

In embodiments, the presence of hydrophobic starch also improves the hydrophobicity of the resulting paper without needing an internal sizing such as alkyl succinic anhydride (ASA), alkyl ketene dimer (AKD) or Rosin. The gelatinized hydrophobic starch sizes the entire thickness of the paper. This property is useful in reducing the coating requirements in making coated sheets. The coating applied using a roller or a metering bar or any such methods, would remain on the surface of the paper and not impregnate the bulk of the paper thus needing less coating to achieve the same amount of gloss and surface finish.

In other embodiments, the addition of a coating agent to the starch can improve its mechanical properties such as bending stiffness or tensile strength, or could improve its optical properties (e.g., TiO2 nanoparticles bound to starch).

4. Surface Treatments Combined with Paper Products

In embodiments, paper products formed in accordance with these systems and methods can be combined with specific surface treatments or coating agents to improve desirable properties of the finished paper sheet. For example, oil and/or grease resistant (OGR) properties can be imparted into the finished paper sheet by adding an OGR coating agent to a paper product being formed as disclosed above.

OGR coatings are used in a variety of commercial applications, including paper and board used in food packaging. Many of these treatments or coatings use fluorinated materials, and others use high amounts of polyolefins or other plastics. Concerns by consumers and regulatory agencies are driving the search for alternative coating materials. In addition to concerns regarding the safety of fluorinated materials, polyolefins or other plastics often make the paper non-recyclable, or too brittle to allow folding or creasing of the treated paper. For these reasons and others, alternative coating materials can be employed that withstand the penetration of oil or grease, while being acceptable to a wider base of consumers. It is desirable that this OGR coating be aqueous-based for use in certain papermaking processes. The coating process using aqueous solutions is often performed using size presses, roll presses, etc., which force the aqueous coating material through the paper substrate. Presently, the coating material has to penetrate the entire paper sheet to achieve a satisfactory coating. Therefore, more coating solution is required than would be needed if the solution just remained on the surface. Saturating the paper sheet with the coating solution also requires a prolonged drying period for the paper sheet. A number of conventional approaches have been employed to reduce the penetration of the coating solution into the paper web, but these have various drawbacks.

Hydrophobic starches, whether gelatinized or ungelatinized, have been used to increase the water holdout of the paper product, thereby reducing the ingress of the aqueous coating solution. The retention of these materials on the paper web is typically poor, though, with non-uniform dispersion on the cellulose fibers. This results in a paper product that can have undesirable mechanical and/or surface properties, along with poor water holdout. In addition, the poor retention leads to a large amount of starch being lost in the whitewater effluent instead of sticking to the paper web. This whitewater contamination has deleterious environmental effects.

Attachment of hydrophobic starches to the paper web as described herein produces good retention of the hydrophobic starches on the cellulose fibers, with markedly less starch loss as compared to conventional techniques. The even and durable distribution of the hydrophobic starch within the paper product results in uniform physical and mechanical properties. The presence of the hydrophobic starch throughout the interior of the paper product also resists the incursion of the aqueous OGR coating. Thus, the OGR coating stays on the surface, so that a smaller amount of coating material is required to produce OGR properties in the paper product. In addition, since the OGR coating does not penetrate the paper matrix, it is easier to dry than conventional OGR products where the coating saturates the entire cellulosic web. Use of the systems and methods disclosed herein for hydrophobic starch attachment can result in more efficient and cost-effective production of OGR specialty paper products that retain advantageous physical and mechanical properties.

OGR agents suitable for these applications include, for example: polyvinyl alcohol, polyvinyl acetate, acrylic emulsions, emulsions of polyethylene or polyolefins, cellulose esters, such as cellulose acetate, celluloseacetatae butyrate, cellulose propionate, carboxy methyl cellulose acetate butyrate and cellulose ethers such as methyl cellulose, ethyl cellulose, hydroxypropyl methylcellulose, and the like.

Figure 9:
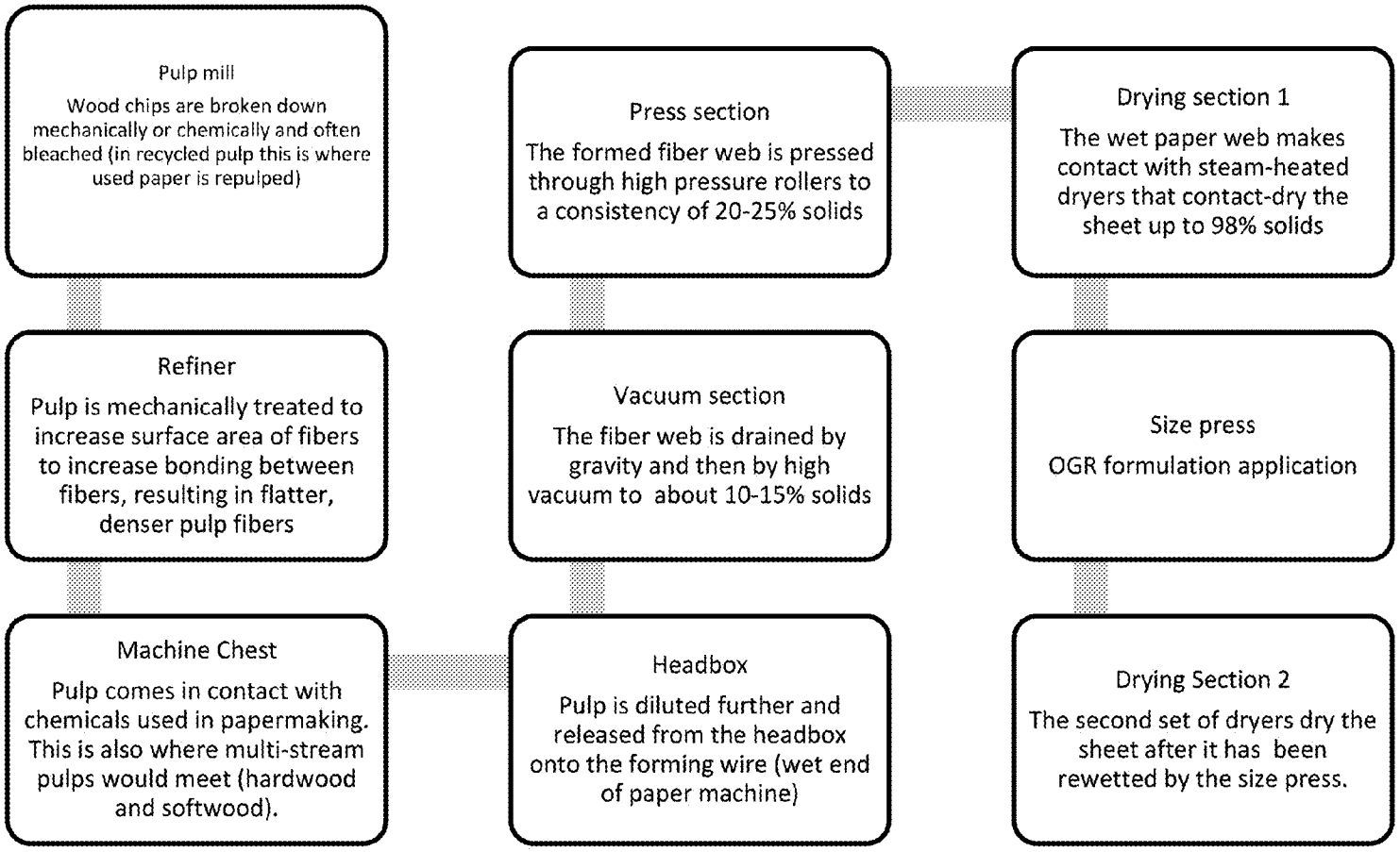
FIG. 9 shows a flow chart for a papermaking process.

In embodiments, the OGR agent would be added to the papermaking process inline in a size press or offline using either a size press or a doctor blade or flexo press or other gravure roll application processes. An illustrative flowchart for adding hydrophobic starch according to the previously described systems and methods is set forth in FIG. 9.

In certain embodiments, an OGR agent can be combined with another agent to impart further desirable properties to the surface of the paper sheet. For example, an OGR agent can be combined with fillers such as calcium carbonate, clay, silica, or various functional additives (e.g., food additives including antioxidants). In one embodiment, an exfoliated clay additive can be combined with the OGR agent, or added separately during the papermaking process. The exfoliated clay additive can be prepared in various ways as would be understood by those of ordinary skill in the art. For example, a formulation comprising exfoliated clay can be prepared by combining an acrylic emulsion and polyethylene glycol diglycidyl ether as a plasticizer with an exfoliated clay suspension in water, mixing them under sonication or vigorous stirring. The same formulation can also be made without the clay just by mixing the acrylic emulsion with the plasticizer to yield flexible oil and grease resistant films on paper surface when combined with the systems and methods for hydrophobic starch attachment as set forth above.

A sheet prepared in accordance with these systems and methods can display advantageous properties such as oil resistance, for example oil resistance when measured in terms of 3M kit test or ANSI test or a boat test. In addition, the process for manufacturing such a paper product would have further advantages. such as requiring less OGR formulation to achieve a given degree of oil resistance (as measured for example by 3M kit score or ANSI score), faster post size-press drying owing to lower moisture absorption within the interior of the paper.

EXAMPLES

Materials

Market softwood and hardwood pulp

Recycled brown pulp

Poly(diallyldimethylammonium chloride), Hi Molecular Weight, 20 wt % in water (polyDADMAC), Sigma-Aldrich, St. Louis, Mo.

MagnaFloc 919, Ciba Specialty Chemicals Corporation, Suffolk, Va.

STA-LOK 300 Starch, Tate & Lyle, Decatur, Ill. (cationic starch)

COSEAL 30061A Anionic Latex, Rohm & Haas, Philedelphia, Pa.

ChitoClear Chitosan CG-10, Primex, Siglufjordur, Iceland

Polyethylene fibers PEFYB-00620, MiniFibers, Inc., Johnson City, Tenn.

Modified Polyethylene fibers PEFYB-ONL490, MiniFibers, Inc., Johnson City, Tenn.

Polypropylene fibers ("PP"), PEFYB-00Y600, MiniFibers, Inc., Johnson City, Tenn.

PES/Nylon pie wedge bicomponent cut fibers

Precipitated Calcium Carbonate (PCC), Sigma-Aldrich, St. Louis, Mo.

Douglas Pearl Starch (unmodified corn starch), Penford Products, Cedar Rapids, Iowa Iron (III) Oxide, <5 um, 99.9%, Sigma-Aldrich, St. Louis, Mo.

Hydrophobic starch Gum 270 Ethylated Starch (Penford Products, Centennial, Colo.)

Acrylic resin—Michelman (Cincinnati, Ohio) Micryl 766R

Poly(propylene glycol), diglycidyl ether—Sigma Aldrich (St. Louis, Mo.) 406740

BASF Montmorillonite Clay—F100

Aldrich Montmorillonite clay

Sodium phosphate, monobasic dehydrate

Sodium hydroxideDeionized water

Example 1

Control Virgin Pulp

A 0.5% slurry was prepared by blending 3.5% by weight softwood and hardwood pulp mixture (in the ratio of 20:80) in water.

Example 2

Control Recycled Pulp

A 0.5% slurry was prepared by blending 22.5% recycled brown pulp in water.

Example 3

Handsheet Preparation

Handsheets were prepared using a Mark V Dynamic Paper Chemistry Jar and Hand-Sheet Mold from Paper Chemistry Laboratory, Inc. (Larchmont, N.Y.). Handsheets were prepared without addition of polymers as controls, using the pulps prepared as described in Example 1 and 2. Handsheets were prepared with the addition of polymers as experimental samples, as described below.

For preparing each experimental handsheet, the appropriate volume of 0.5% pulp slurry prepared in accordance with Examples 1 or 2 (as applicable) was activated with up to 2% of the selected polymer(s) (based on dry weight), as described below in more detail. Polymer additions were performed at 5 minute intervals. This polymer-containing slurry was diluted with up to 3 L of water and added to the handsheet maker, where it was mixed at a rate of 1100 RPM for 5 seconds, 700 RPM for 5 seconds, and 400 RPM for 5 seconds. The water was then drained off. The subsequent sheet was then transferred off of the wire, pressed and dried.

For preparing sheets containing low melting point synthetic fibers PEFYB-00620, PEFYB-0NL490, PEFYB-00Y600, as described below in Example 9, the sheets were dried as described above and then heated further to ensure melting of the synthetic fibers.

Example 4

Tensile Test

Tensile tests were conducted on control and experimental samples using an Instron 3343. Samples of handsheets for tensile testing were initially cut into 1 in wide strips with a paper cutter, and then attached within the Instron 3343. The gauge length region was set at 4 in and the crosshead speed was 1 in/minute. Thickness was measured to provide stress data as was the weight to be able to normalize the data by weight of samples. The strips were tested to failure with an appropriate load cell. At least three strips from each control or experimental handsheet sample were tested and the values were averaged together.

Example 5

Preparation of Latex-Coated Starch

StaLok 300 cationic starch was dispersed in water in slurry form such that the solids content was about 20%. COSEAL 30061A anionic latex was added to the cationic starch, up to 50% by weight of starch. The latex is spontaneously self-assembled on the starch surface resulting in a clear solution when the starch settles down. By contrast, the latex solution without starch remains milky white, as shown in FIG. 1.

Example 6

Preparation of Latex-Coated Starch with Tether

StaLok 300 cationic starch was dispersed in water in slurry form such that the solids content was about 20%. COSEAL 30061A anionic latex was added to the cationic starch, up to 50% by weight of starch. MagnaFloc 919 was then added 0.1% by weight as a tethering agent.

Example 7

Process for Preparing Handsheets from Activated Pulp and Latex-Coated Starch (With and Without Tether)

800 mL of a 0.5% pulp slurry prepared in accordance with Example 1 or 2 (as applicable) was initially provided. The pulp slurry was activated with 0.1% by fiber weight poly-DADMAC. Separately, tethered cationic starch granules were prepared as a slurry in accordance with Example 5 and 6. Each slurry was mixed for 5 minutes and then combined and mixed for another 5 minutes using an overhead stirrer. Handsheets were then produced by the method in Example 3. The final basis weight was approximately 80 gsm for these handsheets.

Example 8

Preparation of Synthetic Fibers with and without Tether

PEFYB-00620, PEFYB-0NL490, PEFYB-00Y600, and PES/Nylon Bicomponent Fibers (and mixtures of two or more of the previous) were dispersed in water in slurry form such that the solids content was about 20%. In samples containing a tether, MagnaFloc 919 was then added 0.1% by weight as a tethering agent.

Example 9

Process for Preparing Handsheets from Activated Pulp and Tethered Synthetic Fibers 800 mL of a 0.5% pulp slurry prepared in accordance with Example 1 or 2 (as applicable) was initially provided. The pulp slurry was activated with 0.1% by fiber weight poly-DADMAC. Separately, synthetic fibers and tethered synthetic fibers were prepared as a slurry in accordance with Example 8. Each slurry was mixed for 5 minutes and then combined and mixed for another 5 minutes using an overhead stirrer. Handsheets were then produced by the method in Example 3. The final basis weight was approximately 80 gsm for these handsheets.

Example 10

Preparation of Chitosan Solution

CG-10 was added to water to make a 1% by weight slurry of chitosan. Strong acid was added dropwise to the slurry with stirring until the solution reached a pH of 2.5 and the chitosan was dissolved.

Example 11

Preparation of Coated Synthetic Fibers with Chitosan

PEFYB-00620, PEFYB-0NL490, PEFYB-00Y600, and PES/Nylon Bicomponent Fibers (and mixtures of two or more of the previous) were dispersed in water in slurry form such that the solids content was about 20%. A strong acid was then added to the slurry to bring the pH below 2.5. The solution in Example 9 was added to the synthetic fiber slurry so that the chitosan was 1% by weight of the synthetic fibers. The pH was then raised back to 8-9 with a strong base to precipitate any unbound chitosan.

Example 12

Process for Preparing Handsheets from Pulp and Chitosan-Coated Synthetic Fibers 800 mL of a 0.5% pulp slurry prepared in accordance with Example 1 or 2 (as applicable) was initially provided. Separately, tethered synthetic fibers were prepared as a slurry in accordance with Example 10. Each slurry was mixed for 5 minutes and then combined and mixed for another 5 minutes using an overhead stirrer. Handsheets were then produced by the method in Example 3. The final basis weight was approximately 80 gsm for these handsheets.

Example 13

The Effect of Latex-Coated Starch on Strength and Hydrophobicity

Figure 2:
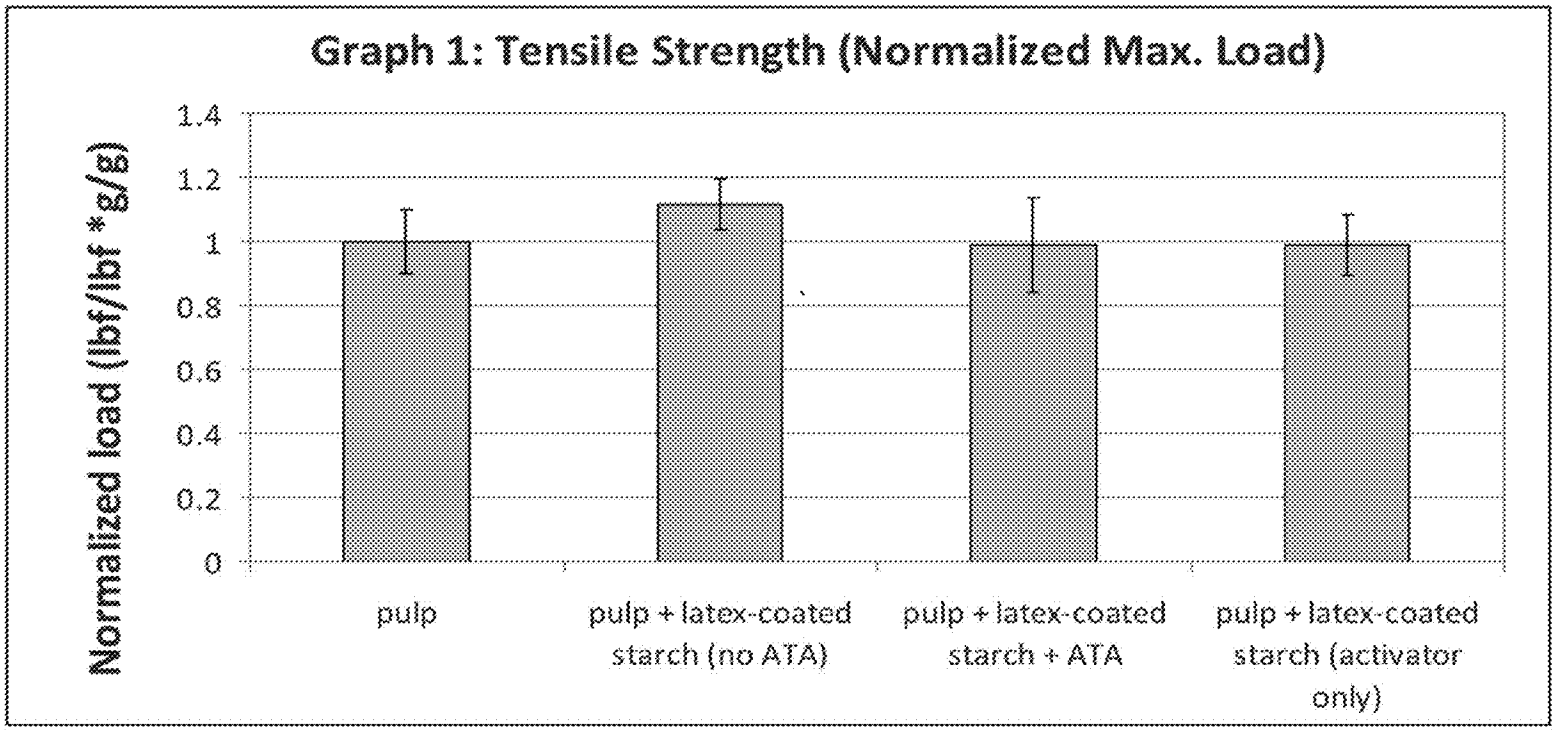
FIG. 2 shows a graph of normalized load for pulp controls vs. experimental preparations.

Samples were prepared as in Example 7, where the amount of latex-coated and latex-coated tether-bearing starch (StaLok 300) was 4.25% of the solids weight. The latex-coated starch had been coated with COSEAL 30061A in accordance with Example 5. The tether-bearing latex-coated starch had been coated with COSEAL30061A and then tethered with MagnaFloc 919 in accordance with Example 6. Samples were made with activator and tether, without either activator or tether, and with activator alone. For ATA-treated samples, the tether used on the starch was 0.1% MagnaFloc 919 by solids and the activator on the pulp was 0.1% polyDADMAC by solids. The max load for each sample was measured using an Instron as in Example 4. Data were normalized by the mass to show load contribution per overall solids weight. Graph 1 (FIG. 2) shows the strength data with all of the aforementioned conditions mentioned in this example. FIG. 2 shows a graph of normalized max. load examining the effect of pulp with and without latex-coated starch and with and without the use of ATA. Normalized loads show that there is no loss or gain in tensile strength with any of the latex-coated starch conditions (within error).

The hydrophobicity improvement with the samples above was also examined. Using handsheet samples prepared as in Example 7, hydrophobicity was tested by depositing a 25 microliter water droplet on the surface of the paper and recording the time for the droplet to completely absorbed by the paper. The results of the hydrophobicity tests are shown in Table 1 (FIG. 3). These results demonstrate that the use of the ATA process (and activator-only) to attach latex-coated starch to pulp fibers improves the water resistance of the paper by up to 14,500% compared to control samples having no added latex-coated starch. FIG. 3 shows a table of normalized water droplet holdout examining the effect of pulp with and without latex-coated starch and with and without the use of ATA. Water droplet holdout times show that there is up to a 145× gain in droplet holdout time with the use of latex-coated starch and pulp activator only.

Example 14

The Effect of Tethered Synthetic Fibers on Strength and Hydrophobicity

Figure 4:
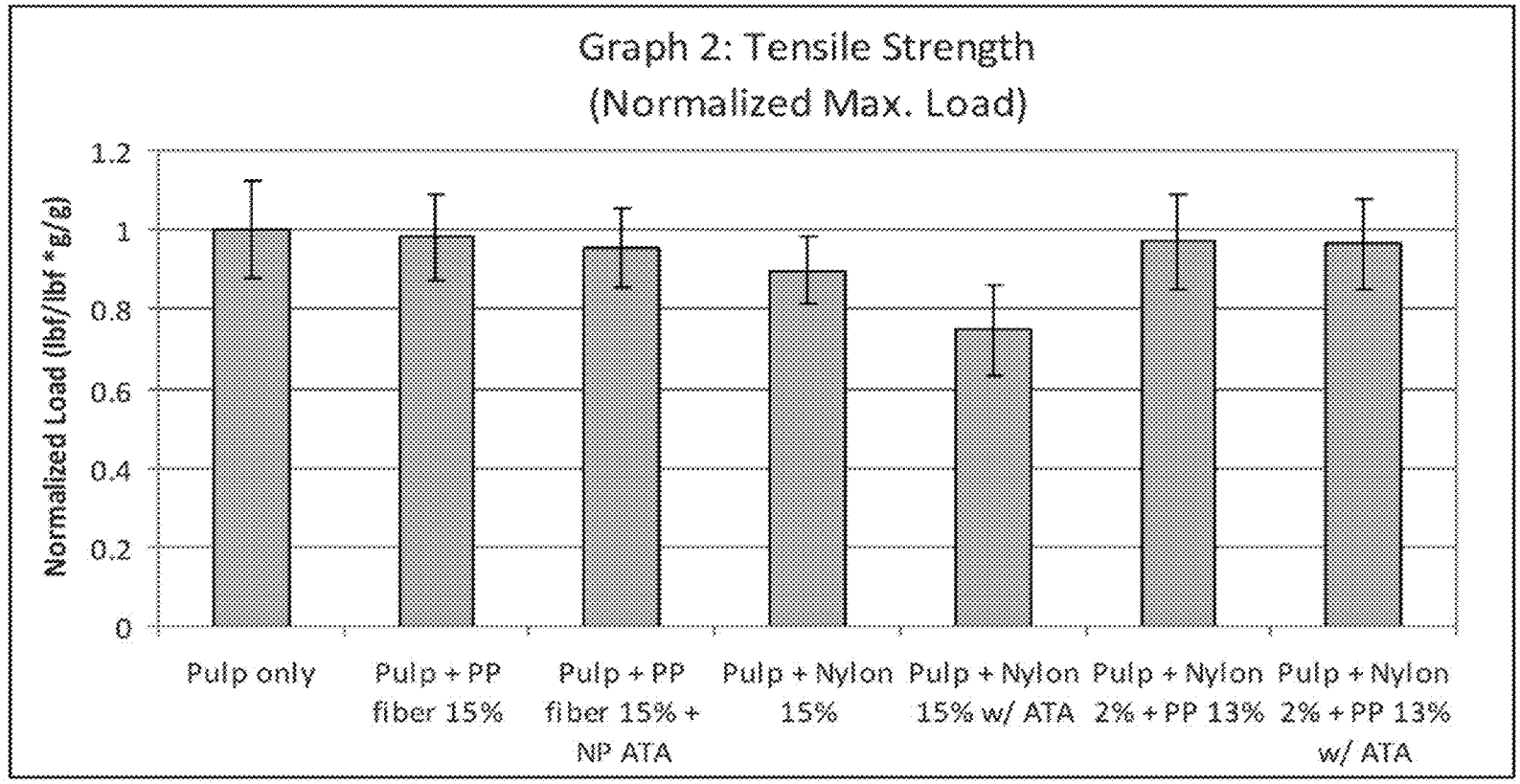
FIG. 4 shows a graph of normalized load for pulp controls vs. experimental preparations.

Samples were prepared as in Example 9, where the amount of tether-bearing synthetic fibers were a total of 15% of the solids weight. The tether-bearing synthetic fibers had been prepared in accordance with Example 8. Samples were made both with activator and tether and without either activator or tether. For ATA-treated samples, the tether used on the synthetic fibers was 0.1% MagnaFloc 919 by solids and the activator on the pulp was 0.1% polyDADMAC by solids. The max load for each sample was measured using an Instron as in Example 4. Data were normalized by the mass to show load contribution per overall solids weight. Graph 2 (FIG. 4) shows the strength data with all of the aforementioned conditions mentioned in this example. FIG. 4 shows a graph of normalized max. load examining the effect of pulp with and without synthetic fibers and with and without the use of ATA. Normalized loads show that there is no loss or gain in tensile strength with any of the conditions (within error). The hydrophobicity improvement with the samples above was also examined. Using fiber handsheet samples prepared as in Example 9, hydrophobicity was tested by depositing a 25 microliter water droplet on the surface of the paper and recording the time for the droplet to completely absorbed by the paper. The results of the hydrophobicity tests are shown in Table 2 (FIG. 5). These results demonstrate that the use of synthetic fibers in combination with pulp fibers improves the water resistance of the paper by up to 26,600% compared to control samples having no added synthetic fibers. FIG. 5 shows a table of normalized water droplet holdout examining the effect of pulp with and without synthetic fibers and with and without the use of ATA. Water droplet holdout times show that there is a >266× gain in droplet holdout time with the use of polypropylene fibers under several conditions.

Example 15

The Effect of Chitosan-Coated Synthetic Fibers on Strength and Hydrophobicity

Figure 6:
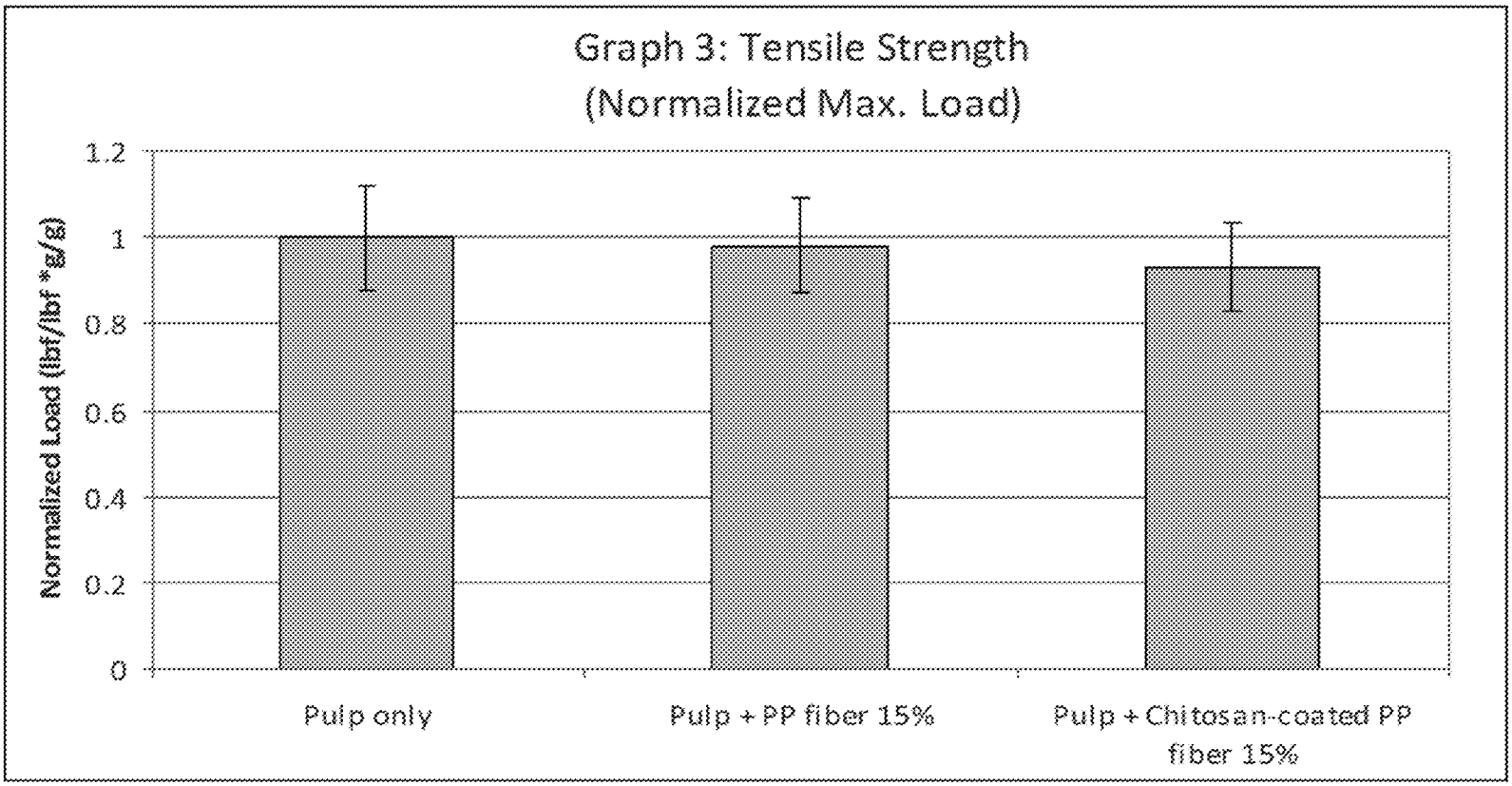
FIG. 6 shows a graph of normalized load for pulp controls vs. experimental preparations.

Samples were prepared as in Example 12, where the amount of chitosan-coated synthetic fibers were a total of 15% of the solids weight. The chitosan-coated synthetic fibers had been prepared in accordance with Example 11. The max load for each sample was measured using an Instron as in Example 4. Data were normalized by the mass to show load contribution per overall solids weight. Graph 3 (FIG. 6) shows the strength data with all of the aforementioned conditions mentioned in this example. FIG. 6 shows a graph of normalized max. load examining the effect of pulp with synthetic fibers with and without the use of chitosan. Normalized loads show that there is no loss or gain in tensile strength with any of the conditions (within error).

The hydrophobicity improvement with the samples above was also examined. Using recycled fiber handsheet samples prepared as in Example 12, hydrophobicity was tested by depositing a 25 microliter water droplet on the surface of the paper and recording the time for the droplet to completely absorbed by the paper. The results of the hydrophobicity tests are shown in Table 3 (FIG. 7). These results demonstrate that the use of chitosan-coated synthetic fibers improves the water resistance of the paper by up to 26,600% compared to control samples having no synthetic fibers. FIG. 7 shows a table of normalized water droplet holdout examining the effect of pulp with and without synthetic fibers and with and without chitosan coating. Water droplet holdout times show that there is a >266× gain in droplet holdout time with the use of polypropylene fibers coated with chitosan.

Example 16

Control Virgin Pulp (Softwood Only)

A 0.5% slurry was prepared by blending 93% solids content softwood in water.

Example 17

Preparation of PCC and Pearl Starch with and without Tether

PCC and Pearl Starch (and mixtures of the two) were dispersed in water in slurry form such that the solids content was about 20%. In samples containing a tether, MagnaFloc 919 was then added 0.05% by weight of solids as a tethering agent.

Example 18

Preparation of a Handsheet with PCC and Pearl Starch 600 mL of a 0.5% pulp slurry prepared in accordance with Example 16 was initially provided. The pulp slurry was activated with 0.1% by fiber weight polyDADMAC. Separately, starch, PCC, and tethered starch/PCC were prepared as a slurry in accordance with Example 17. Each slurry was mixed for 5 minutes and then combined and mixed for another 5 minutes using an overhead stirrer. Handsheets were then produced by the method in Example 16. The final basis weight was approximately 60 gsm for these handsheets.

Example 19

The Effect of PCC and Pearl Starch on Strength

Figure 8:
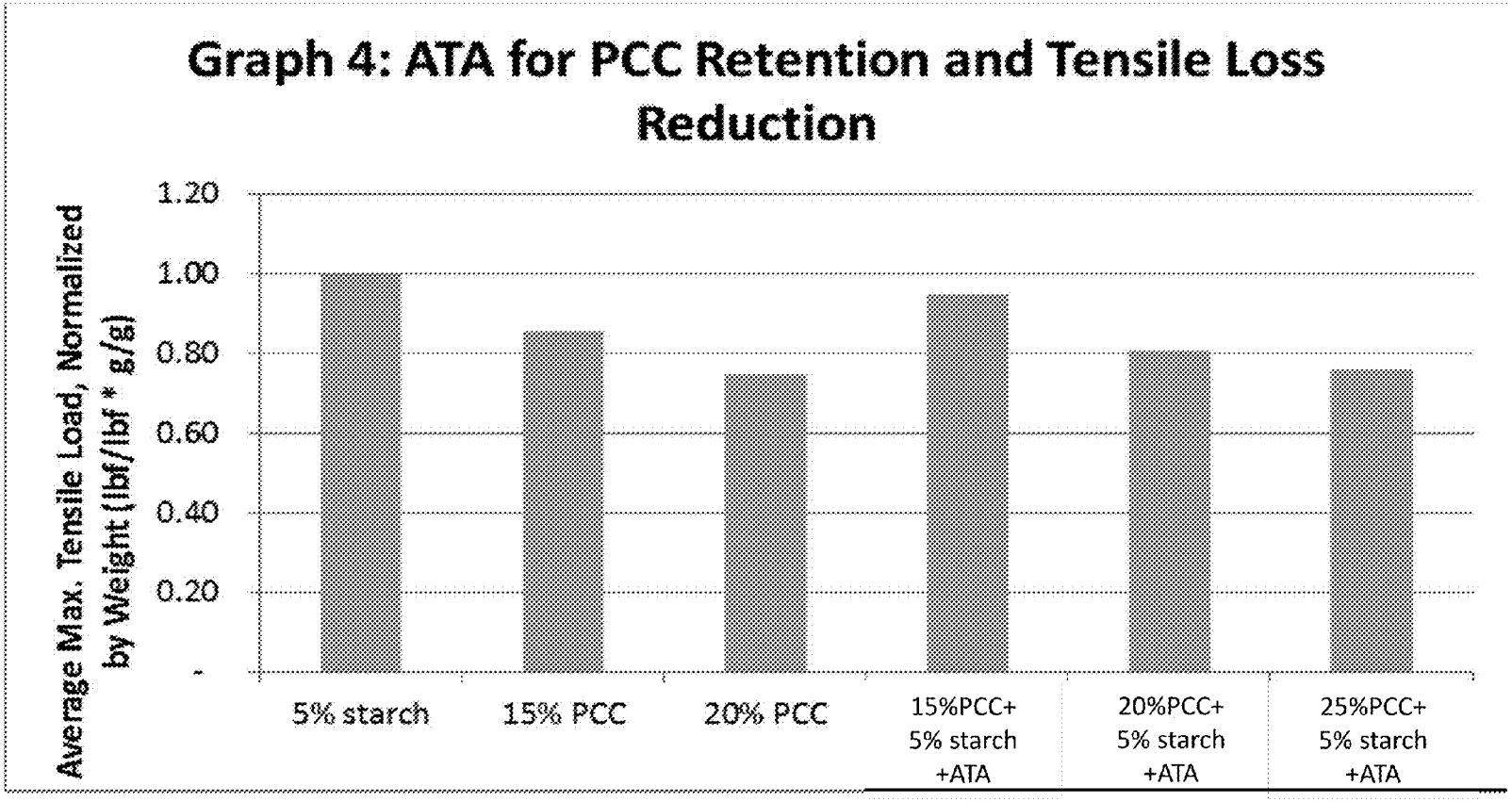
FIG. 8 shows a graph of normalized load for pulp plus additive controls vs. experimental preparations.

Samples were prepared as in Example 18, where the amount of PCC, Pearl Starch, tether-bearing pearl starch and PCC was between 5% and 30% of the solids weight. The tethered PCC with pearl starch had been prepared with MagnaFloc 919 in accordance with Example 17. Samples were made with both activator and tether or with neither activator nor tether. For ATA-treated samples, the tether used on the dry-mixed pearl starch and PCC and was 0.05% MagnaFloc 919 by solids and the activator on the pulp was 0.1% polyDADMAC by solids. The max load for each sample was measured using an Instron as in Example 16. Data were normalized by the mass to show load contribution per overall solids weight. Graph 4 (FIG. 8) shows the strength data with all of the aforementioned conditions mentioned in this example. As shown in FIG. 8, the ATA treatment improves retention and reduces the loss of tensile strength at similar loadings of PCC.

Example 20

Preparation of Iron (III) Oxide with and without Tether

Iron (III) Oxide particles were dispersed in water in slurry form such that the solids content was about 20%. In samples containing a tether, MagnaFloc 919 was then added 0.05% by weight of solids as a tethering agent.

Example 21

Preparation of a Handsheet with Iron (III) Oxide 600 mL of a 0.5% pulp slurry prepared in accordance with Example 16 was initially provided. The pulp slurry was activated with 0.1% by fiber weight polyDADMAC. Separately, Iron (III) Oxide with and without tether were prepared as a slurry in accordance with Example 20. Each slurry was mixed for 5 minutes and then combined and mixed for another 5 minutes using an overhead stirrer. Handsheets were then produced by the method in Example 16. The final basis weight was approximately 60 gsm for these handsheets.

Example 22

Analysis of Magnetization of Iron (III) Oxide Handsheets

1" by 2" pieces of handsheets with iron (III) oxide prepared in Example 21 were held to a ceramic magnet to verify holdout of Iron (III) Oxide in the sheet. Sheets containing as little as 5% Iron (III) oxide by solids weight held onto the magnet with no other support.

Example 23

Preparation of Hydrophobic Starch with and without Tether

Hydrophobic starch granules were dispersed in water in slurry form such that the solids content was about 20%. In samples containing a tether, MagnaFloc 919 was then added 0.05% by weight of solids as a tethering agent.

Example 24

Preparation of a Handsheet with Hydrophobic Starch 600 mL of a 0.5% pulp slurry prepared in accordance with Example 16 was initially provided. The pulp slurry was activated with 0.1% by fiber weight polyDADMAC. Separately, hydrophobic starch and tethered hydrophobic starch were prepared as a slurry, with the tethered samples prepared by adding MagnaFloc 919 at 0.05% by weight of solids as a tethering agent. Each slurry was mixed for 5 minutes and then combined and mixed for another 5 minutes using an overhead stirrer. Handsheets were then produced by the method in Example 3.

Example 25

Acrylic Resin

For this Example, the coating was prepared as follows: a draw down was performed with the test solution using a 6" bar with a 5 mil gap. A single coat of the test solution was applied (unless otherwise specified) on a basis sheet and left to air dry. In the examples below, the following test procedures were used: A 23.3% solids solution was prepared by diluting 4 mL Micryl 766R (35% solids w/v) with 2 mL water. The ANSI score of the coat was 12 without a crease and 6 with a crease. The boat test was not performed.

Example 26

OGR Coating with Acrylic Resin and Poly(Propylene Glycol)Diglycidyl Ether Terminated A 31.7% solids solution was prepared by dissolving 0.5 g poly(propylene glycol), diglycidyl ether terminated, in 4 mL of Micryl 766R and diluting the mixture with 2 mL water. The solution was coated onto the hydrophobic starch paper made in Example 24.

The ANSI test was then performed as follows: The ANSI test, TAPPI test method T 559, which expands upon TAPPI UM 557 "Repellency of Paper and Board to Grease, Oil, and Waxes (Kit Test)," involved releasing a drop of a mixture of castor oil, heptane, and toluene (twelve different mixtures are made and numbered 1-12 based on the aggressiveness of the mixture, with 12 being the most aggressive solvent mixture and aggressiveness being determined by the percentage of small molecular weight species having a higher penetration power than the higher molecular weight fatty acids (here, castor oil)) onto the coating for 15 seconds and determining if the sheet darkened in color. The score was ranked from 1-12 (12 is best) and the coating was given the highest number it passes.

The ANSI score of the coat was 12 without a crease and 12 with a crease. The boat test (described below in Example 32) resulted in no grease spots.

Example 27

Preparation of Extractant Solutions

A solution of 0.141% NaOH was prepared by adding 1.41 g NaOH to 1 L water and stirring to dissolve all NaOH (basic solution). A solution of 0.274% $NaH_2PO_4.2H_2O$ was prepared by adding 2.74 g $NaH_2PO_4.2H_2O$ to 1 L of water and stirring to dissolve all $NaH_2PO_4.2H_2O$ (phosphate solution). A solution of NaOH and $NaH_2PO_4.2H_2O$ was made so that for every two NaOH molecules there is one $NaH_2PO_4.2H_2O$ molecule. NaOH was chosen to be 0.0353 M, so $NaH_2PO_4.2H_2O$ was added to this solution at 0.0176 M. The resulting solution was 1.41 g NaOH and 2.74 g $NaH_2PO_4.2H_2O$ in 1 L of water (phosphate/base solution).

Example 28

Exfoliation of Montmorillonite Clays

For each clay sample (F100 and Aldrich), four vials were prepared. To begin, 300 mg of the clay sample was added to each of the four vials. 15 mL water was added to one of each vial for F100 and Aldrich clay. The remaining three sample vials were also suspended in 15 mL each of phosphate, phosphate/base and basic extractant solutions prepared in accordance with Example 27. The vials were each shaken vigorously for 15 seconds and then placed into an ultrasonic bath (Model 75T Aquasonic by VWR Scientific Products) for 30 minutes. The ultrasonicated vials were allowed to settle for 1 hour and a photograph was taken. By this time, the water controls had completely settled. Pictures were then taken periodically to measure the amount of time the exfoliated clays were stably suspended in solution. After 28 days, the F100 and Aldrich clays exfoliated with phosphate/base solutions remained suspended, whereas the rest of the samples settled.

Example 29

OGR Coating with Acrylic Resin and Poly(Propylene Glycol)Diglycidyl Ether Terminated and Exfoliated Clay A 34.3% solids solution was prepared by dissolving 0.5 g poly(propylene glycol)(200), digycidyl ether terminated and 0.5 g by dry weight of exfoliated clay solution in 4 mL Micryl 766R under sonication. The resulting OGR solution was then coated onto the hydrophobic paper made in Example 24.

Example 30

Fatty Acid Test to Determine the Grease Resistance of Paper and Paperboard

The fatty acid test, (developed by Solvay Chemicals utilizes natural fatty acids to determine the grease resistance of paper. A set of test solutions is prepared with various amounts of castor oil, oleic acid, and octanoic acid. Each member of the test solution set is ranked from 1 to 11, with 1 being the least aggressive solution (i.e., having a lower percentage of a smaller molecular weight fatty acid (here octanoic acid) with higher penetration power than the higher molecular weight fatty acids (here, castor oil or oleic acid)) and 11 being the most aggressive. The solutions are heated to 60° C. and a drop of each is placed on the test paper and the paper is placed in a 60° C. oven for 5 minutes. After five minutes the drop is wiped off and the paper is examined. Failure is indicated by the darkening or discoloring of the test paper. The paper is given the score of the highest number of solution that can be applied without failure (i.e., darkening or discoloration after five minutes).

Example 31

Kit Test to Determine the Grease Resistance of Paper and Paperboard

The ANSI test, TAPPI test method T 559, which expands upon TAPPI UM 557 "Repellency of Paper and Board to Grease, Oil, and Waxes (Kit Test)," was employed in certain examples. The test involved releasing a drop of a mixture of castor oil, heptane, and toluene (twelve different mixtures are made and numbered 1-12 based on the aggressiveness of the mixture, with 12 being the most aggressive solvent mixture) onto the coating for 15 seconds and determining if the sheet darkened in color. Failure is indicated by the darkening or discoloring of the test paper. The paper is given the score of the highest number of solution that can be applied without failure, using a ranking from 1-12 (the "Kit Score").

Example 32

Boat Test to Determine the Grease Resistance of Paper and Paperboard

The boat test was performed by creating a boat-shaped construct with the coated sheet so that it can hold oil. To perform this test, a 5" by 6" piece of coated paper was creased in the middle by applying 20 psi of pressure, and then the edges were folded up to create a boat-like structure. Palm oil was placed in the boat and the boat was place in an oven on a piece of paper for 24 hrs at 37° C. The paper underneath the boat was observed for grease spots after the given time and the number and diameter of the spots were recorded.

While this invention has been particularly shown and described with references to preferred embodiments thereof, it will be understood by those skilled in the art that various changes in form and details may be made therein without departing from the scope of the invention encompassed by the appended claims.

The invention claimed is:

1. A method for manufacturing a paper product, comprising:

activating a first population of fibers in a liquid medium with an activator, forming a second population of composite additive particles, wherein the composite additive particles comprise two or more additives attached to each other and wherein one of the additives is a hydrophobic starch, treating the second population with a tethering material to form tether-bearing composite additive particles, adding the tether-bearing composite additive particles to the activated population of fibers to form a treated paper matrix, wherein the tethering material interacts with the activator, adding an oil and/or grease resistant coating to the surface of the treated paper matrix to form a coated paper matrix, and manufacturing the paper product from the coated paper matrix.

2. The method of claim 1, wherein the first population comprises cellulosic fibers.

3. The method of claim 1, wherein the first population comprises synthetic fibers.

4. The method of claim 1, wherein the composite additive particles further comprises an additive selected from the group of calcium carbonate, dolomite, calcium sulfate, kaolin, talc, titanium dioxide, silica, aluminum hydroxide, and silver colloid.

5. The method of claim 1, wherein the composite additive particles comprise calcium carbonate and the hydrophobic starch.

6. The method of claim 1, wherein the oil and/or grease resistant coating comprises an agent selected from the group consisting of polyvinyl alcohol, polyvinyl acetate, acrylic emulsions, emulsions of polyethylene or polyolefins, cellulose esters and cellulose ethers.

7. The method of claim 6, wherein the cellulose ester is selected from the group consisting of cellulose acetate, cellulose acetate butyrate, cellulose propionate, and carboxy methyl cellulose acetate butyrate.

8. The method of claim 6, wherein the cellulose either is selected from the group consisting of methyl cellulose, ethyl cellulose, and hydroxypropyl methylcellulose.

9. The method of claim 1, wherein the oil resistance of the paper product is about 12 as measured by the ANSI test with a crease.

10. The method of claim 1, wherein hydrophobic starch is gelatinized.

11. The method of claim 1, wherein hydrophobic starch is ungelatinized.

12. The method of claim 1, wherein the activator is a cationic polymer and the tethering material is an anionic polymer.

13. The method of claim 1, wherein the activator is an anionic polymer and the tethering material is a cationic polymer.

14. The method of claim 1, wherein the composite additive particles further comprises precipitated calcium carbonate.

* * * * *